US009395660B2

(12) United States Patent
Fujii et al.

(10) Patent No.: US 9,395,660 B2
(45) Date of Patent: Jul. 19, 2016

(54) IMAGE FORMING APPARATUS AND IMAGE FORMING METHOD INCLUDING FORMING A CLEANING TONER IMAGE

(71) Applicants: Tomohiko Fujii, Tokyo (JP); Masahiro Samei, Osaka (JP); Yoshiharu Takahashi, Osaka (JP); Daisuke Inoue, Tokyo (JP); Yoshihiro Fukuhata, Hyogo (JP); Minoru Toyoda, Hyogo (JP)

(72) Inventors: Tomohiko Fujii, Tokyo (JP); Masahiro Samei, Osaka (JP); Yoshiharu Takahashi, Osaka (JP); Daisuke Inoue, Tokyo (JP); Yoshihiro Fukuhata, Hyogo (JP); Minoru Toyoda, Hyogo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/798,831

(22) Filed: Jul. 14, 2015

(65) Prior Publication Data

US 2016/0041511 A1 Feb. 11, 2016

(30) Foreign Application Priority Data

Aug. 11, 2014 (JP) ..... 2014-163726

(51) Int. Cl.
*G03G 15/20* (2006.01)

(52) U.S. Cl.
CPC .. *G03G 15/2025* (2013.01); *G03G 2215/00531* (2013.01)

(58) Field of Classification Search
CPC ..... G03G 15/2015
USPC ..... 399/327
See application file for complete search history.

(56) References Cited

U.S. PATENT DOCUMENTS

| | | | | |
|---|---|---|---|---|
| 5,138,390 | A * | 8/1992 | Miyabayashi | G03G 15/2025 15/256.51 |
| 6,094,559 | A * | 7/2000 | Otsuka | G03G 15/2025 399/327 |
| 8,472,853 | B2 * | 6/2013 | Akamatsu | G03G 15/2025 399/327 |
| 8,532,551 | B2 * | 9/2013 | Tetsuno | G03G 15/2025 399/327 |
| 8,606,157 | B2 * | 12/2013 | Yoshioka | G03G 15/6573 399/327 |

(Continued)

FOREIGN PATENT DOCUMENTS

| | | |
|---|---|---|
| JP | 3-058074 | 3/1991 |
| JP | 2009-031551 | 2/2009 |

(Continued)

OTHER PUBLICATIONS

U.S. Appl. No. 14/587,273, filed Dec. 31, 2014.

(Continued)

*Primary Examiner* — Billy Lactaoen
*Assistant Examiner* — Arlene Heredia Ocasio
(74) *Attorney, Agent, or Firm* — Oblon, McClelland, Maier & Neustadt, L.L.P

(57) ABSTRACT

An image forming apparatus includes an image forming device to form a cleaning toner image in a cleaning region on a cleaning sheet and a check toner image in a check region on the cleaning sheet. The image forming apparatus further includes a fixing device including a first rotator and a heater to heat the first rotator to a cleaning temperature that is lower than a fixing temperature to which the first rotator is heated in a print job and higher than a cold offset temperature at which toner adheres to the first rotator by cold offset. Each of the cleaning region and the check region has a length greater than a circumferential length of the first rotator. The cleaning region and the check region are disposed at a leading section and a trailing section of the cleaning sheet in a cleaning sheet conveyance direction, respectively.

19 Claims, 8 Drawing Sheets

(56) References Cited

U.S. PATENT DOCUMENTS

| | | | | |
|---|---|---|---|---|
| 8,909,113 | B2 * | 12/2014 | Kawajiri | G03G 15/2025 399/327 |
| 2002/0001476 | A1 * | 1/2002 | Nagamine | G03G 15/2035 399/45 |
| 2004/0213610 | A1 * | 10/2004 | Yuasa | B41J 3/60 399/401 |
| 2007/0223976 | A1 | 9/2007 | Yagi et al. | |
| 2008/0008482 | A1 * | 1/2008 | Kurita | G03G 15/553 399/33 |
| 2008/0013992 | A1 | 1/2008 | Fukuhata et al. | |
| 2008/0013993 | A1 | 1/2008 | Obata et al. | |
| 2008/0031664 | A1 | 2/2008 | Yagi et al. | |
| 2008/0063442 | A1 | 3/2008 | Yagi et al. | |
| 2008/0069611 | A1 | 3/2008 | Obata et al. | |
| 2010/0178089 | A1 | 7/2010 | Fukuhata | |
| 2010/0239297 | A1 | 9/2010 | Sakaya et al. | |
| 2010/0260524 | A1 | 10/2010 | Hiraoka et al. | |
| 2010/0272481 | A1 | 10/2010 | Yamamoto et al. | |
| 2011/0052285 | A1 | 3/2011 | Fukuhata | |
| 2011/0103837 | A1 | 5/2011 | Toyoda et al. | |
| 2011/0188874 | A1 | 8/2011 | Takahashi et al. | |
| 2011/0299899 | A1 | 12/2011 | Ishigaya et al. | |
| 2011/0311283 | A1 | 12/2011 | Fukuhata | |
| 2012/0020681 | A1 | 1/2012 | Naitoh et al. | |
| 2012/0020690 | A1 | 1/2012 | Yamamoto et al. | |
| 2012/0045241 | A1 | 2/2012 | Takahashi et al. | |
| 2012/0093532 | A1 | 4/2012 | Ishigaya et al. | |
| 2012/0093534 | A1 | 4/2012 | Waida et al. | |
| 2012/0148287 | A1 | 6/2012 | Samei et al. | |
| 2012/0148317 | A1 | 6/2012 | Samei et al. | |
| 2012/0177422 | A1 | 7/2012 | Nanno et al. | |
| 2012/0189360 | A1 * | 7/2012 | Shirai | G03G 15/2025 399/327 |
| 2012/0195652 | A1 | 8/2012 | Takahashi et al. | |
| 2012/0243895 | A1 | 9/2012 | Samei et al. | |
| 2012/0275834 | A1 | 11/2012 | Naitoh et al. | |
| 2013/0004213 | A1 | 1/2013 | Takahashi | |
| 2013/0004214 | A1 | 1/2013 | Sakaya et al. | |
| 2013/0004217 | A1 | 1/2013 | Ikeda et al. | |
| 2013/0004222 | A1 | 1/2013 | Sakaya et al. | |
| 2013/0051876 | A1 | 2/2013 | Ishigaya et al. | |
| 2013/0064583 | A1 * | 3/2013 | Yoshida | G03G 15/2025 399/327 |
| 2013/0064586 | A1 | 3/2013 | Adachi et al. | |
| 2013/0308990 | A1 | 11/2013 | Masahiro Samei et al. | |
| 2014/0056625 | A1 | 2/2014 | Naitoh et al. | |
| 2014/0072354 | A1 | 3/2014 | Toyoda et al. | |
| 2014/0072357 | A1 | 3/2014 | Fukuhata et al. | |
| 2014/0093288 | A1 | 4/2014 | Naitoh et al. | |
| 2014/0099138 | A1 | 4/2014 | Ishigaya et al. | |
| 2014/0099146 | A1 | 4/2014 | Fujii et al. | |
| 2014/0112691 | A1 | 4/2014 | Nanno et al. | |
| 2014/0119784 | A1 * | 5/2014 | Nakabayashi | G03G 15/2025 399/327 |
| 2014/0133877 | A1 | 5/2014 | Samei et al. | |
| 2014/0133884 | A1 | 5/2014 | Toyoda et al. | |
| 2014/0153982 | A1 | 6/2014 | Adachi et al. | |
| 2014/0153983 | A1 | 6/2014 | Fujii et al. | |
| 2014/0219672 | A1 | 8/2014 | Samei et al. | |
| 2014/0219673 | A1 | 8/2014 | Yamamoto et al. | |
| 2014/0219696 | A1 | 8/2014 | Fujimoto et al. | |
| 2014/0227001 | A1 | 8/2014 | Kishi et al. | |
| 2014/0314459 | A1 | 10/2014 | Samei | |
| 2015/0063865 | A1 | 3/2015 | Furuichi et al. | |
| 2015/0071688 | A1 | 3/2015 | Yamaguchi et al. | |
| 2015/0078768 | A1 | 3/2015 | Yamaguchi et al. | |
| 2015/0117901 | A1 | 4/2015 | Kichise et al. | |
| 2015/0139705 | A1 | 5/2015 | Furuichi et al. | |

FOREIGN PATENT DOCUMENTS

| | | |
|---|---|---|
| JP | 2010-032987 | 2/2010 |
| JP | 2010-249971 | 11/2010 |
| JP | 2011-232689 | 11/2011 |
| JP | 2012-189871 | 10/2012 |

OTHER PUBLICATIONS

U.S. Appl. No. 14/602,766, filed Jan. 22, 2015.
U.S. Appl. No. 14/609,028, filed Jan. 29, 2015.

* cited by examiner

IMAGE FORMING APPARATUS AND IMAGE FORMING METHOD INCLUDING FORMING A CLEANING TONER IMAGE

CROSS-REFERENCE TO RELATED APPLICATION

This patent application is based on and claims priority pursuant to 35 U.S.C. §119 to Japanese Patent Application No. 2014-163726, filed on Aug. 11, 2014, in the Japanese Patent Office, the entire disclosure of which is hereby incorporated by reference herein.

BACKGROUND

1. Technical Field

Exemplary aspects of the present disclosure relate to an image forming apparatus and an image forming method, and more particularly, to an image forming apparatus for forming a toner image on a recording medium and an image forming method for forming a toner image on a recording medium.

2. Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a first rotator, such as a fixing roller, a fixing belt, and a fixing film, heated by a heater and a second rotator, such as a pressure roller and a pressure belt, pressed against the first rotator to form a fixing nip therebetween through which a recording medium bearing a toner image is conveyed. As the recording medium bearing the toner image is conveyed through the fixing nip, the first rotator and the second rotator apply heat and pressure to the recording medium, melting and fixing the toner image on the recording medium.

SUMMARY

This specification describes below an improved image forming apparatus. In one exemplary embodiment, the image forming apparatus includes an image forming device to form a cleaning toner image having an increased toner density in a cleaning region on a cleaning sheet and a check toner image having a decreased toner density in a check region on the cleaning sheet. The image forming apparatus further includes a fixing device disposed downstream from the image forming device in a cleaning sheet conveyance direction. The fixing device includes a first rotator and a second rotator pressed against the first rotator to form a fixing nip therebetween, through which the cleaning sheet is conveyed. At least one of the first rotator and the second rotator is adhered with stain toner. A heater heats the first rotator to a cleaning temperature that is lower than a fixing temperature to which the first rotator is heated in a print job and higher than a cold offset temperature at which toner adheres to the first rotator by cold offset. Each of the cleaning region and the check region has a length greater than a circumferential length of the first rotator. The cleaning region is disposed at a leading section of the cleaning sheet in the cleaning sheet conveyance direction. The check region is disposed at a trailing section of the cleaning sheet in the cleaning sheet conveyance direction.

This specification further describes an improved image forming method. In one exemplary embodiment, the image forming method includes forming a cleaning toner image in a cleaning region on a first side of a cleaning sheet; forming a check toner image in a check region on the first side of the cleaning sheet; conveying the cleaning region through a fixing nip formed between a first rotator adhered with stain toner and a second rotator while the first side of the cleaning sheet contacts the first rotator; and conveying the check region through the fixing nip while the first side of the cleaning sheet contacts the first rotator.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
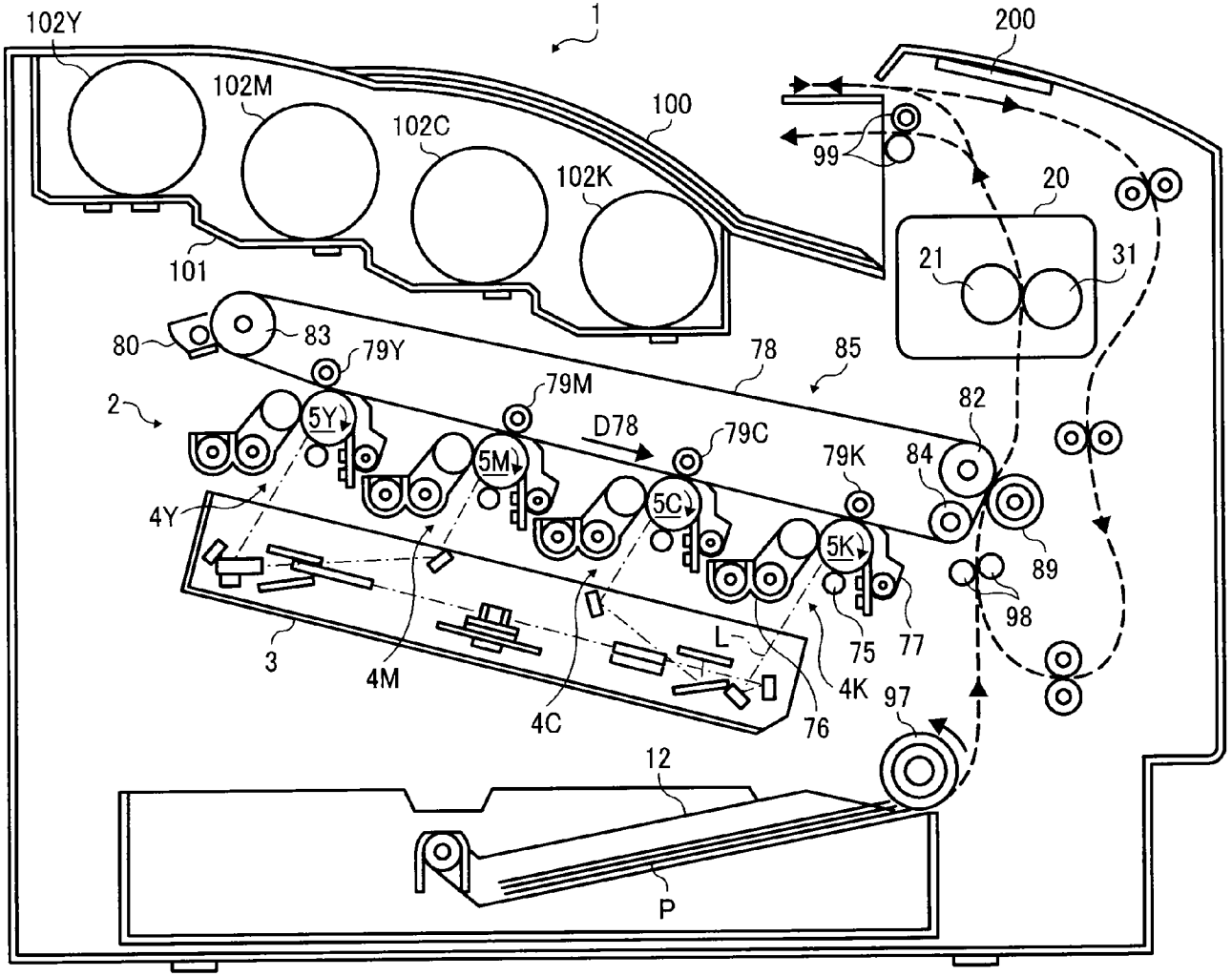
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 1 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 1. The image forming apparatus 1 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 1 is a color printer that forms color and monochrome toner images on recording media by electrophotography. Alternatively, the image forming apparatus 1 may be a monochrome printer that forms a monochrome toner image on a recording medium.

A description is provided of a construction of the image forming apparatus 1.

As shown in FIG. 1, the image forming apparatus 1 is a tandem color printer. In an upper portion of the image forming apparatus 1 is a bottle housing 101 that accommodates four toner bottles 102Y, 102M, 102C, and 102K containing fresh yellow, magenta, cyan, and black toners, respectively, and being detachably attached to the bottle housing 101 for replacement.

Below the bottle housing 101 is an intermediated transfer unit 85. The intermediate transfer unit 85 includes an intermediate transfer belt 78 disposed opposite four image forming devices 4Y, 4M, 4C, and 4K, arranged along the intermediate transfer belt 78, that form yellow, magenta, cyan, and black toner images, respectively. The image forming devices 4Y, 4M, 4C, and 4K include photoconductive drums 5Y, 5M, 5C, and 5K, respectively.

Each of the photoconductive drums 5Y, 5M, 5C, and 5K is surrounded by a charger 75, a developing device 76, a cleaner 77, a discharger, and the like. Image forming processes including a charging process, an exposure process, a developing process, a primary transfer process, and a cleaning process are performed on each of the photoconductive drums 5Y, 5M, 5C, and 5K, forming yellow, magenta, cyan, and black toner images on the photoconductive drums 5Y, 5M, 5C, and 5K, respectively. A driving motor drives and rotates the photoconductive drums 5Y, 5M, 5C, and 5K clockwise in FIG. 1.

The charger 75 disposed opposite each of the photoconductive drums 5Y, 5M, 5C, and 5K uniformly charges an outer circumferential surface thereof in the charging process. When the charged outer circumferential surface of each of the photoconductive drums 5Y, 5M, 5C, and 5K reaches an irradiation position where an exposure device 3 is disposed opposite each of the photoconductive drums 5Y, 5M, 5C, and 5K, a laser beam L emitted from the exposure device 3 irradiates and scans the photoconductive drums 5Y, 5M, 5C, and 5K, forming electrostatic latent images according to yellow, magenta, cyan, and black image data in the exposure process.

When the scanned outer circumferential surface of each of the photoconductive drums 5Y, 5M, 5C, and 5K reaches a developing position where the developing device 76 is disposed opposite each of the photoconductive drums 5Y, 5M, 5C, and 5K, the developing device 76 develops the electrostatic latent image formed on the respective photoconductive drums 5Y, 5M, 5C, and 5K, thus forming yellow, magenta, cyan, and black toner images on the photoconductive drums 5Y, 5M, 5C, and 5K in the developing process. When the yellow, magenta, cyan, and black toner images formed on the photoconductive drums 5Y, 5M, 5C, and 5K reach primary transfer nips formed between the photoconductive drums 5Y, 5M, 5C, and 5K and the intermediate transfer belt 78 by four primary transfer bias rollers 79Y, 79M, 79C, and 79K pressed against the four photoconductive drums 5Y, 5M, 5C, and 5K via the intermediate transfer belt 78, respectively, the yellow, magenta, cyan, and black toner images formed on the photoconductive drums 5Y, 5M, 5C, and 5K, respectively, are primarily transferred onto the intermediate transfer belt 78 in the primary transfer process.

After the primary transfer process, residual toner failed to be transferred onto the intermediate transfer belt 78 remains on the photoconductive drums 5Y, 5M, 5C, and 5K slightly. When the residual toner on each of the photoconductive drums 5Y, 5M, 5C, and 5K reaches a cleaning position where the cleaner 77 is disposed opposite each of the photoconductive drums 5Y, 5M, 5C, and 5K, a cleaning blade of the cleaner 77 mechanically collects the residual toner from each of the photoconductive drums 5Y, 5M, 5C, and 5K in the cleaning process.

Finally, when the cleaned outer circumferential surface of each of the photoconductive drums 5Y, 5M, 5C, and 5K reaches a discharging position where the discharger is disposed opposite each of the photoconductive drums 5Y, 5M, 5C, and 5K, the discharger eliminates residual potential from each of the photoconductive drums 5Y, 5M, 5C, and 5K. Thus, a series of image forming processes performed on the photoconductive drums 5Y, 5M, 5C, and 5K is finished.

A detailed description is now given of transfer processes performed on the intermediate transfer belt 78.

The yellow, magenta, cyan, and black toner images primarily transferred from the photoconductive drums 5Y, 5M, 5C, and 5K onto the intermediate transfer belt 78 are superimposed on a same position on the intermediate transfer belt 78, forming a color toner image thereon.

For example, the intermediate transfer unit 85 includes the intermediate transfer belt 78, the four primary transfer bias rollers 79Y, 79M, 79C, and 79K, a secondary transfer backup roller 82, a cleaning backup roller 83, a tension roller 84, and an intermediate transfer belt cleaner 80.

The intermediate transfer belt 78 is stretched taut across and supported by the three rollers, that is, the secondary transfer backup roller 82, the cleaning backup roller 83, and the tension roller 84. One of the three rollers, that is, the secondary transfer backup roller 82 drives and rotates the intermediate transfer belt 78 counterclockwise in FIG. 1 in a rotation direction D78. The four primary transfer bias rollers 79Y, 79M, 79C, and 79K sandwich the intermediate transfer belt 78 together with the four photoconductive drums 5Y, 5M, 5C, and 5K, respectively, forming the four primary transfer nips between the intermediate transfer belt 78 and the photoconductive drums 5Y, 5M, 5C, and 5K.

The primary transfer bias rollers 79Y, 79M, 79C, and 79K are applied with a primary transfer bias having a polarity opposite a polarity of electric charge of toner. As the intermediate transfer belt 78 rotates in the rotation direction D78 and travels through the four primary transfer nips successively, the yellow, magenta, cyan, and black toner images formed on the four photoconductive drums 5Y, 5M, 5C, and 5K, respectively, are primarily transferred onto the intermediate transfer belt 78 such that the yellow, magenta, cyan, and black toner images are superimposed on the same position on the intermediate transfer belt 78.

Thereafter, the yellow, magenta, cyan, and black toner images superimposed on the intermediate transfer belt 17 reach a secondary transfer position where a secondary transfer roller 89 is disposed opposite the intermediate transfer belt 78. At the secondary transfer position, the secondary transfer backup roller 82 sandwiches the intermediate transfer belt 78 together with the secondary transfer roller 89, forming a secondary transfer nip between the secondary transfer roller 89 and the intermediate transfer belt 78. The yellow, magenta, cyan, and black toner images superimposed on the intermediate transfer belt 78 are secondarily transferred onto a recording medium P conveyed through the secondary transfer nip in a secondary transfer process.

After the secondary transfer process, residual toner failed to be transferred on the recording medium P remains on the intermediate transfer belt 78. When the residual toner on the intermediate transfer belt 78 reaches a cleaning position where the intermediate transfer belt cleaner 80 is disposed opposite the intermediate transfer belt 78, the intermediate transfer belt cleaner 80 collects the residual toner from the intermediate transfer belt 78.

Thus, a series of transfer processes performed on the intermediate transfer belt 78 is finished. As described above, an image forming portion 2 including the photoconductive drums 5Y, 5M, 5C, and 5K and their peripherals and the intermediate transfer belt 78 and its peripherals forms the yellow, magenta, cyan, and black toner images constituting the color toner image. The recording medium P conveyed through the secondary transfer nip is conveyed from a paper tray 12 situated in a lower portion of the image forming apparatus 1 through a feed roller 97, a timing roller pair 98 (e.g., a registration roller pair), and the like.

The paper tray 12 loads a plurality of recording media P (e.g., sheets) layered thereon. As the feed roller 97 rotates counterclockwise in FIG. 1, the feed roller 97 feeds an uppermost recording medium P to a roller nip formed between two rollers of the timing roller pair 98. As the recording medium P contacts the roller nip, the timing roller pair 98 that interrupts its rotation temporarily halts the recording medium P.

The timing roller pair 98 resumes its rotation to feed the recording medium P to the secondary transfer nip at a time when the color toner image formed on the intermediate transfer belt 78 reaches the secondary transfer nip. As the recording medium P is conveyed through the secondary transfer nip, the color toner image formed on the intermediate transfer belt 78 is secondarily transferred onto the recording medium P.

Thereafter, the recording medium P transferred with the color toner image at the secondary transfer nip is conveyed to a fixing device 20. The fixing device 20 includes a fixing roller 21 serving as a fixing rotator or a first rotator and a pressure roller 31 serving as a pressure rotator or a second rotator pressed against the fixing roller 21 to form a fixing nip therebetween. As the recording medium P bearing the color toner image is conveyed through the fixing nip, the fixing roller 21 and the pressure roller 31 fix the color toner image on the recording medium P under heat and pressure.

Thereafter, the recording medium P bearing the fixed toner image is ejected by an output roller pair 99 onto an outside of the image forming apparatus 1. The recording medium P ejected by the output roller pair 99 onto the outside of the image forming apparatus 1 is stacked on an output tray 100 as a print. Thus, a series of image forming processes performed by the image forming apparatus 1 is completed.

A description is provided of a construction of the fixing device 20 incorporated in the image forming apparatus 1.

Figure 2:
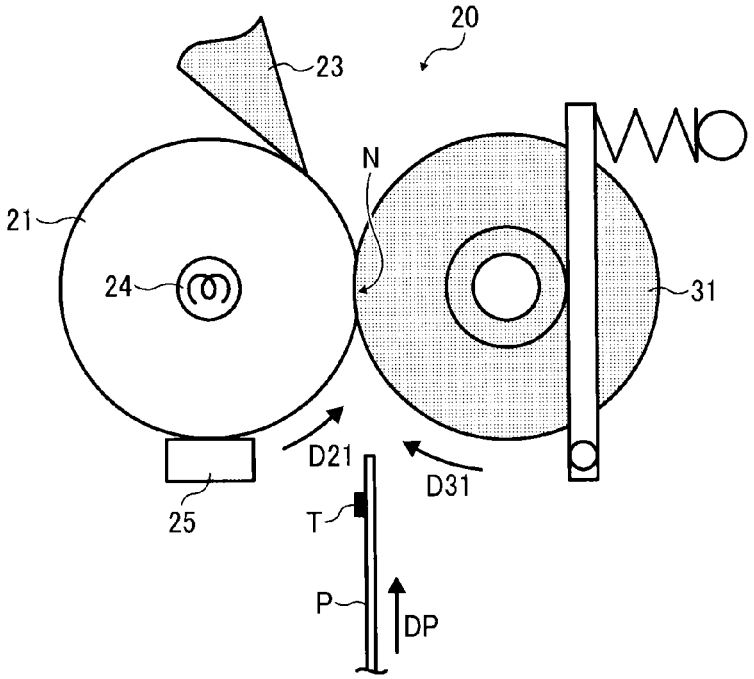
FIG. 2 is a schematic vertical sectional view of a fixing device installed in the image forming apparatus shown in FIG. 1.

FIG. 2 is a schematic vertical sectional view of the fixing device 20. As shown in FIG. 2, the fixing device 20 (e.g., a fuser or a fusing unit) includes two rotators, that is, the fixing roller 21 and the pressure roller 31 contacting the fixing roller 21 to form a fixing nip N therebetween. The fixing device 20 further includes a heater 24, a separator 23, and a thermistor 25. The heater 24 serving as a heater or a heat source is disposed inside the fixing roller 21 to heat the fixing roller 21. A driver (e.g., a motor) drives and rotates the fixing roller 21 counterclockwise in FIG. 2 in a rotation direction D21 and the pressure roller 31 clockwise in a rotation direction D31.

A detailed description is now given of a construction of the fixing roller 21.

The fixing roller 21 is a tube constructed of a heat conductive base layer and a release layer coating the base layer. The heat conductive base layer is made of a material having a desired mechanical strength and an increased thermal conductivity such as carbon steel and aluminum.

The release layer constituting an outer circumferential surface of the fixing roller 21 is made of a material that has an increased thermal conductivity and an increased durability and facilitates separation of toner of a toner image T on the recording medium P from the fixing roller 21. For example, the release layer as a coating layer is a tube made of tetrafluoroethylene-perfluoroalkylvinylether copolymer (PFA), a coating with fluoroplastic such as PFA or polytetrafluoroethylene (PTFE), a silicone rubber layer, a fluorine rubber layer, or the like.

A detailed description is provided of a construction of the pressure roller 31.

The pressure roller 31 is a tube constructed of a cored bar, an elastic layer coating an outer circumferential surface of the cored bar, and a coating layer coating the elastic layer. For example, the cored bar is an STKM carbon steel tube for machine structural purposes or the like. The elastic layer is made of silicone rubber, fluoro rubber, or a foam of those. The coating layer is a heat resistant fluoroplastic tube that facilitates separation of the recording medium P from the pressure roller 31 such as PFA and PTFA. A pressurization mechanism (e.g., a spring) biases and presses the pressure roller 31 against the fixing roller 21.

A detailed description is now given of a configuration of the separator 23.

The separator 23 is disposed downstream from the fixing nip N in a recording medium conveyance direction DP at an upper position in FIG. 2. The separator 23, disposed opposite the fixing roller 21, includes a pawl having a sharp front edge. According to this exemplary embodiment, four separators 23 are aligned in an axial direction of the fixing roller 21. However, the number of the separators 23 is not limited to four as long as the number of the separators 23 is plural.

The separator 23 is made of a material that facilitates separation of the recording medium P from the separator 23 and sliding of the recording medium P over the separator 23, such as PFA, polyetherketone (PEK), and polyetheretherketone (PEEK). Alternatively, a surface of the separator 23 may be coated with a material that facilitates separation of the recording medium P from the separator 23 and sliding of the recording medium P over the separator 23, such as PFA and Teflon®.

A contact-direction biasing member anchored to each of the separators 23 biases each separator 23 against the fixing roller 21. The contact-direction biasing member is a helical tension spring, for example. Alternatively, other biasing members may be employed as the contact-direction biasing member in view of various conditions including an installation space and manufacturing costs. The contact-direction biasing member biases each separator 23 against the fixing roller 21, bringing each separator 23 into contact with the fixing roller 21.

The fixing roller 21 is surrounded by the thermistor 25 serving as a temperature detector that detects the temperature of the fixing roller 21, a thermostat that prevents an abnormal temperature of the fixing roller 21, and the like. A controller described below controls the heater 24 to maintain the temperature of the outer circumferential surface of the fixing roller 21 in a predetermined temperature range based on a detection signal sent from the thermistor 25.

The fixing roller 21 is susceptible to adhesion of various faulty toner such as toner failed to be melted under shortage of heat (e.g., cold offset toner), toner melted excessively under excessive heat (e.g., hot offset toner), and toner remaining on the fixing roller 21 under electric action. The faulty toner adhered to the fixing roller 21 as stain toner may also be adhered to the pressure roller 31 as the pressure roller 31 comes into contact with the fixing roller 21 while the recording medium P is absent at the fixing nip N.

Accordingly, the stain toner containing paper dust may adhere to at least one of the fixing roller 21 and the pressure roller 31. If the stain toner is transferred from the fixing roller 21 and the pressure roller 31 onto the recording medium P, the stain toner may degrade the toner image T on the recording medium P into a faulty toner image.

A description is provided of cleaning of the fixing roller 21.

Figure 3A:
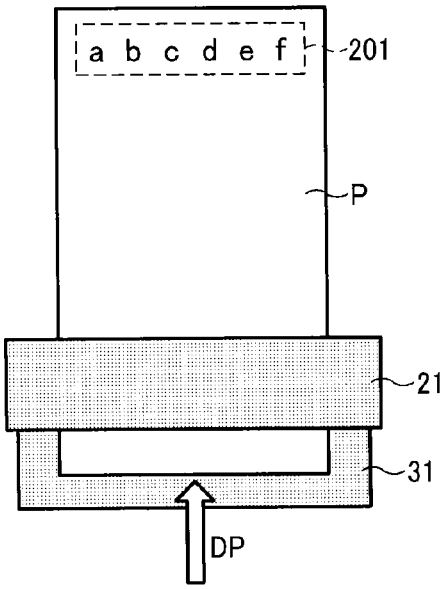
FIG. 3A is a plan view of a recording medium conveyed over a fixing roller incorporated in the fixing device shown in FIG. 2 when the fixing roller is not adhered with stain toner.
Figure 3B:
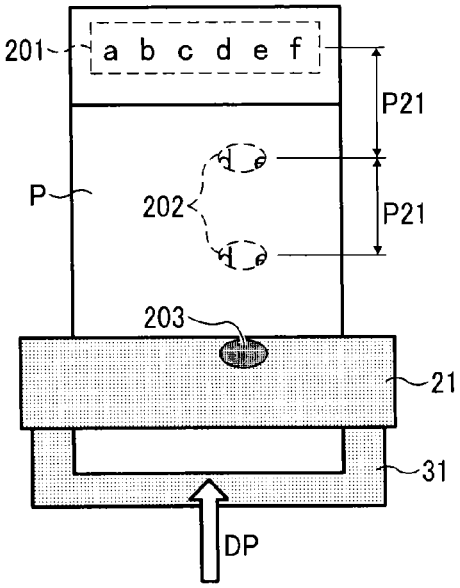
FIG. 3B is a plan view of the recording medium conveyed over the fixing roller shown in FIG. 3A when the fixing roller is adhered with stain toner.

FIG. 3A is a plan view of a recording medium P conveyed over the fixing roller 21 not adhered with stain toner. FIG. 3B is a plan view of a recording medium P conveyed over the fixing roller 21 adhered with stain toner. As shown in FIG. 3A, when the recording medium P bearing an unfixed toner image 201 is conveyed over the fixing roller 21 not adhered with a stain toner 203 that stains the fixing roller 21, the fixing roller 21 attains a fixing property of heating the recording medium P sufficiently, forming no offset toner image on the recording medium P. Conversely, as shown in FIG. 3B, when the fixing roller 21 is adhered with the stain toner 203, the fixing property of a portion of the fixing roller 21 that is adhered with the stain toner 203 may degrade. Accordingly, the unfixed toner image 201 conveyed over the stain toner 203 on the fixing roller 21 may not be fixed on the recording medium P sufficiently. Consequently, a plurality of offset toner images 202 is formed on the recording medium P with a circumferential pitch P21 of the fixing roller 21 between the toner image 201 and the offset toner image 202 and between the two adjacent offset toner images 202 in a circumferential direction of the fixing roller 21, resulting in faulty fixing.

Figure 4:
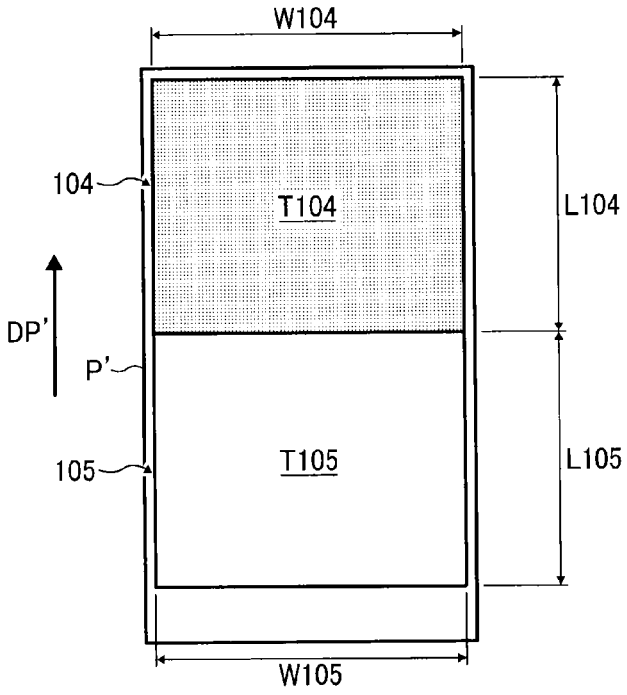
FIG. 4 is a plan view of a sheet used for cleaning in the fixing device shown in FIG. 2.

FIG. 4 is a plan view of a sheet P', that is, a recording medium, used for cleaning in the fixing device 20 according to this exemplary embodiment. The sheet P' serving as a cleaning sheet used for cleaning is made of a material of the recording medium P used for printing. As a user selects a cleaning mode available in the image forming apparatus 1, the image forming apparatus 1 forms a predetermined image pattern on the sheet P'. For example, the image forming portion 2 depicted in FIG. 1 creates a cleaning region 104 on a leading section on the sheet P' in a sheet conveyance direction DP' identical to the recording medium conveyance direction DP depicted in FIGS. 2, 3A, and 3B. A check region 105 contiguous to the cleaning region 104 is created on a trailing section on the sheet P' in the sheet conveyance direction DP'. The cleaning region 104 and the check region 105 are created on at least one of a first side (e.g., a front side) of the sheet P' and a second side (e.g., a back side) of the sheet P'. It is to be noted that a recording medium used in the cleaning mode is referred to as the sheet P' to distinguish it from the recording medium P used for printing.

The image forming portion 2 forms an unfixed cleaning toner image T104 in the cleaning region 104 on the sheet P'. The unfixed cleaning toner image T104 in the cleaning region 104, as it is heated at the fixing nip N, attains adhesion to attract stain (e.g., the stain toner 203) from an outer circumferential surface of the fixing roller 21 and the pressure roller 31 without offset, thus fixing stain on the sheet P'. The unfixed cleaning toner image T104 in the cleaning region 104 is a solid toner image formed with toner at a print rate of 100 percent or a high-density toner image as described below.

A length L104 of the cleaning region 104 in the sheet conveyance direction DP' is not smaller than a circumferential length of the fixing roller 21. A width W104 of the cleaning region 104 in the axial direction of the fixing roller 21 perpendicular to the sheet conveyance direction DP' corresponds to a maximum width of the sheet P' available in the image forming apparatus 1. The check region 105, disposed upstream from the cleaning region 104 in the sheet conveyance direction DP', has a length L105 not smaller than the circumferential length of the fixing roller 21 or the length L104 of the cleaning region 104 in the sheet conveyance direction DP'. The check region 105 is used for the user to check whether or not the cleaning region 104 has finished attracting stain (e.g., the stain toner 203) from the outer circumferential surface of the fixing roller 21 and the pressure roller 31. A width W105 of the check region 105 in the axial direction of the fixing roller 21 also corresponds to the maximum width of the sheet P' available in the image forming apparatus 1.

The length L104 of the cleaning region 104 is not smaller than a circumferential length of the pressure roller 31 when the sheet P' is used to remove stain toner from the pressure roller 31. The check region 105 is a solid white region formed at a print rate of zero percent or formed with a check toner image T105 at a toner density smaller than at least a toner density of the cleaning toner image T104 in the cleaning region 104. The print rate is determined to form an evaluation toner image. For example, the print rate of a solid black toner image formed in the cleaning region 104 on the sheet P' is 100 percent. The print rate of a toner image formed in the check region 105 on the sheet P' is not greater than about 50 percent.

As the sheet P' is conveyed through the fixing device 20 in the cleaning mode as in a print mode to form the toner image T on the recording medium P, the single sheet P' removes the stain toner 203 from the fixing roller 21 and allows the user to check whether or not the stain toner 203 is removed from the fixing roller 21 successfully. Accordingly, if the stain toner 203 adhered to the outer circumferential surface of the fixing roller 21 forms a faulty toner image on the recording medium P, the user removes the stain toner 203 from the fixing roller 21 and checks whether or not the stain toner 203 is removed from the fixing roller 21 successfully with the single sheet P'.

A temperature of the fixing roller 21 in the cleaning mode is adjusted to be lower than a temperature of the fixing roller 21 that fixes the toner image T on the recording medium P in the print mode and to be in a temperature range that does not cause cold offset. The temperature of the fixing roller 21 in the cleaning mode which is lower than that in the print mode increases adhesion of toner of the cleaning toner image T104 in the cleaning region 104 on the sheet P', causing the sheet P' to remove the stain toner 203 from the fixing roller 21 effectively.

Cold offset defines a phenomenon in which toner of the toner image T on the recording medium P peels off the recording medium P and adheres to the outer circumferential surface of the fixing roller 21 when the temperature of the fixing roller 21 is excessively low. A threshold temperature at which cold offset occurs varies depending on the configuration of a fixing device and the type of toner. For example, a lower limit temperature at which cold offset does not occur is in a range of from 110 degrees centigrade to 140 degrees centigrade. Similarly, an upper limit temperature of the fixing roller 21 in the cleaning mode varies depending on the configuration of the fixing device and the type of toner. For example, the upper limit temperature of the fixing roller 21 in the cleaning mode is in a range of from about 150 degrees centigrade to about 170 degrees centigrade.

If the fixing roller 21 is not adhered with the stain toner 203 or if the stain toner 203 has been removed from the fixing roller 21, no faulty toner image caused by transfer of the stain toner 203 from the fixing roller 21 is formed in the check region 105 on the sheet P'. Conversely, if the stain toner 203 has not been removed from the fixing roller 21 completely and therefore remains on the fixing roller 21, the stain toner 203 adhered to the fixing roller 21 causes faulty fixing as described with reference to FIG. 3B. The unfixed cleaning toner image T104 formed in the cleaning region 104 on the sheet P' is transferred onto the check region 105 on the sheet P' via the stain toner 203 adhered to the fixing roller 21. Thus, a faulty toner image appears in the check region 105 on the sheet P' as an offset toner image.

Accordingly, the user readily determines whether or not the stain toner 203 on the outer circumferential surface of the fixing roller 21 has been removed completely by checking whether or not the faulty toner image is formed in the check region 105 on the single sheet P' after the cleaning mode.

A description is provided of two examples of a pattern of the sheet P'.

Figure 5A:
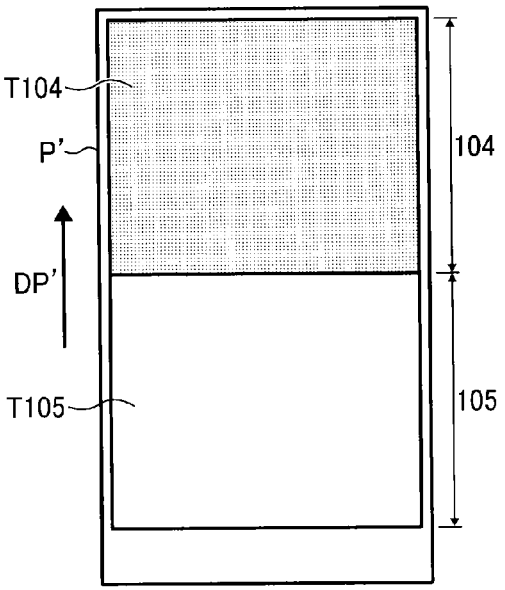
FIG. 5A is a plan view of the sheet shown in FIG. 4 illustrating one example of a pattern thereon.
Figure 5B:
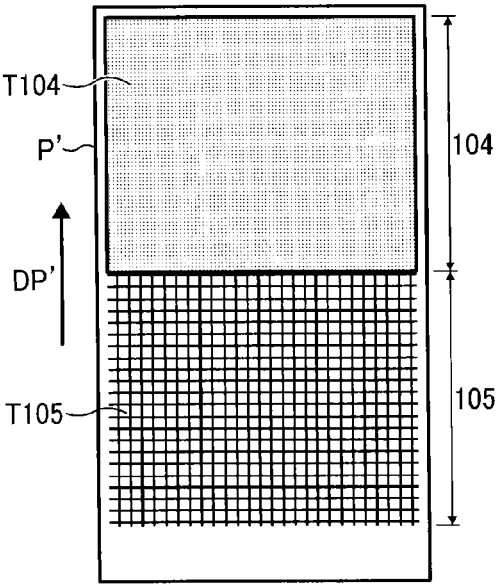
FIG. 5B is a plan view of the sheet shown in FIG. 4 illustrating another example of the pattern thereon.

The cleaning region 104 is produced with a pattern made of a solid toner image formed with toner at the print rate of 100 percent or a high-density toner image. FIG. 5A is a plan view of the sheet P' illustrating one example of the pattern. As shown in FIG. 5A, the check region 105 is produced with the check toner image T105 such as a white background of paper, a solid white toner image, or a halftone image. FIG. 5B is a plan view of the sheet P' illustrating another example of the pattern. As shown in FIG. 5B, the check region 105 is produced with the check toner image T105 having a toner density or a print rate smaller than that of the cleaning toner image T104 in the cleaning region 104 such as a ruled image.

Accordingly, the toner density or the print rate of the check toner image T105 in the check region 105 is changed or adjusted to allow the user to select options (e.g., the toner density and the print rate of the check toner image T105 in the check region 105) available in the cleaning mode according to an amount of the stain toner 203 or the like inside the fixing device 20. Consequently, usability of the image forming apparatus 1 is improved and waste of toner is prevented.

Figure 6:
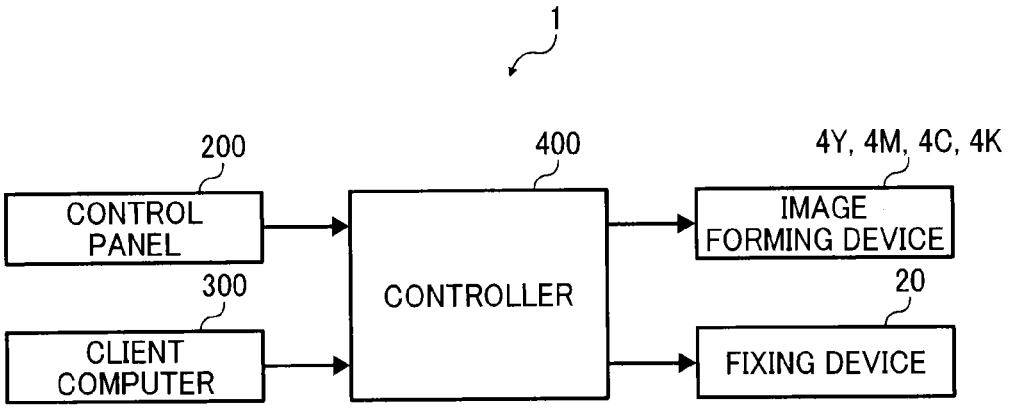
FIG. 6 is a block diagram of the image forming apparatus shown in FIG. 1.

FIG. 6 is a block diagram of the image forming apparatus 1. The user changes or adjusts settings and the print rate in the cleaning mode by using a control panel 200 disposed atop the image forming apparatus 1 as shown in FIG. 1 or a client computer 300 connected to the image forming apparatus 1. The settings include fixing conditions such as the temperature of the fixing roller 21 heated by the heater 24, pressure with which the pressure roller 31 is pressed against the fixing roller 21, and the conveyance speed at which the fixing roller 21 and the pressure roller 31 convey the recording medium P and the sheet P' through the fixing nip N. As shown in FIG. 6, a controller 400 (e.g., a processor) is a micro-computer including a central processing unit (CPU), a read-only memory (ROM), a random-access memory (RAM), and an input-output (I/O) interface. The controller 400, operatively connected to the control panel 200, the client computer 300, the image forming devices 4Y, 4M, 4C, and 4K, and the fixing device 20, controls the image forming devices 4Y, 4M, 4C, and 4K and the fixing device 20 to perform the cleaning mode according to an instruction input by the user through the control panel 200 or the client computer 300.

As shown in FIGS. 5A and 5B, the check toner image T105 is formed in the check region 105 on the sheet P' with a color identical to or different from a color of the cleaning toner image T104 formed in the cleaning region 104 on the sheet P'. In order to create the cleaning region 104 and the check region 105 on the identical sheet P', the length of the sheet P' in the sheet conveyance direction DP' is not smaller than the combined length of the length of the cleaning region 104 and the length of the check region 105 in the sheet conveyance direction DP'.

A description is provided of a method for evaluating a result of the cleaning mode by checking the check region 105 on the sheet P'.

In the cleaning mode, the sheet P' is conveyed through the fixing nip N formed between the fixing roller 21 and the pressure roller 31 to move the stain toner 203 adhered to the outer circumferential surface of the fixing roller 21 to the cleaning region 104 on the sheet P'.

Figure 7A:
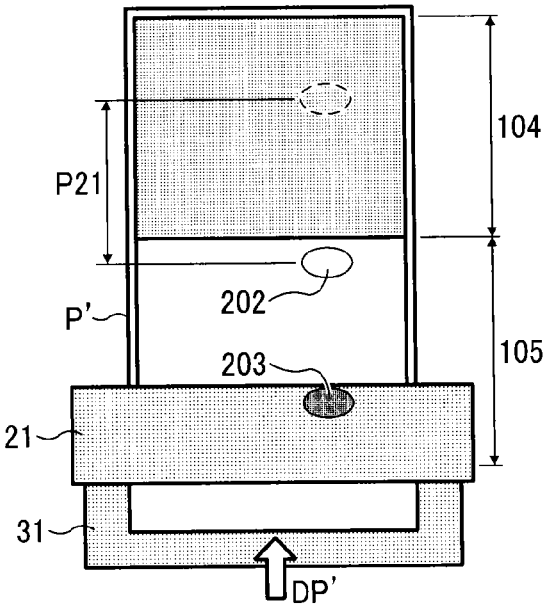
FIG. 7A is a plan view of the sheet shown in FIG. 4 when the sheet bears an offset toner image.
Figure 7B:
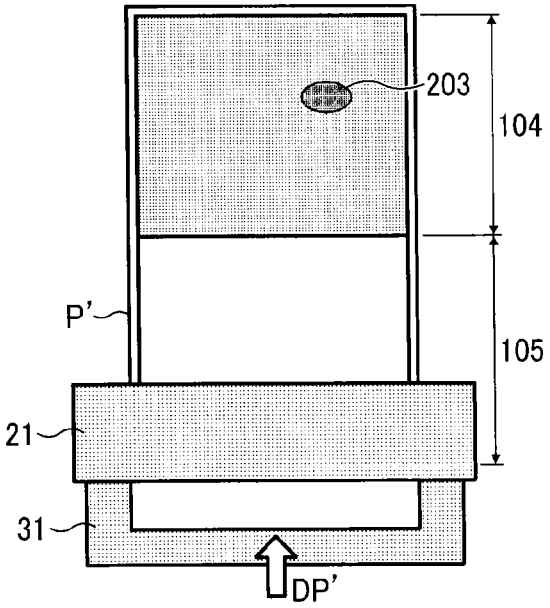
FIG. 7B is a plan view of the sheet shown in FIG. 4 when the sheet does not bear the offset toner image.

FIG. 7A is a plan view of the sheet P' bearing the offset toner image 202. If the check region 105 on the sheet P' bears the offset toner image 202 as shown in FIG. 7A, the user determines that the stain toner 203 has not been removed from the fixing roller 21 completely. FIG. 7B is a plan view of the sheet P' not bearing the offset toner image 202. If the check region 105 on the sheet P' does not bear the offset toner image 202 as shown in FIG. 7B, the user determines that the stain toner 203 has been removed from the fixing roller 21 successfully.

Figure 8:
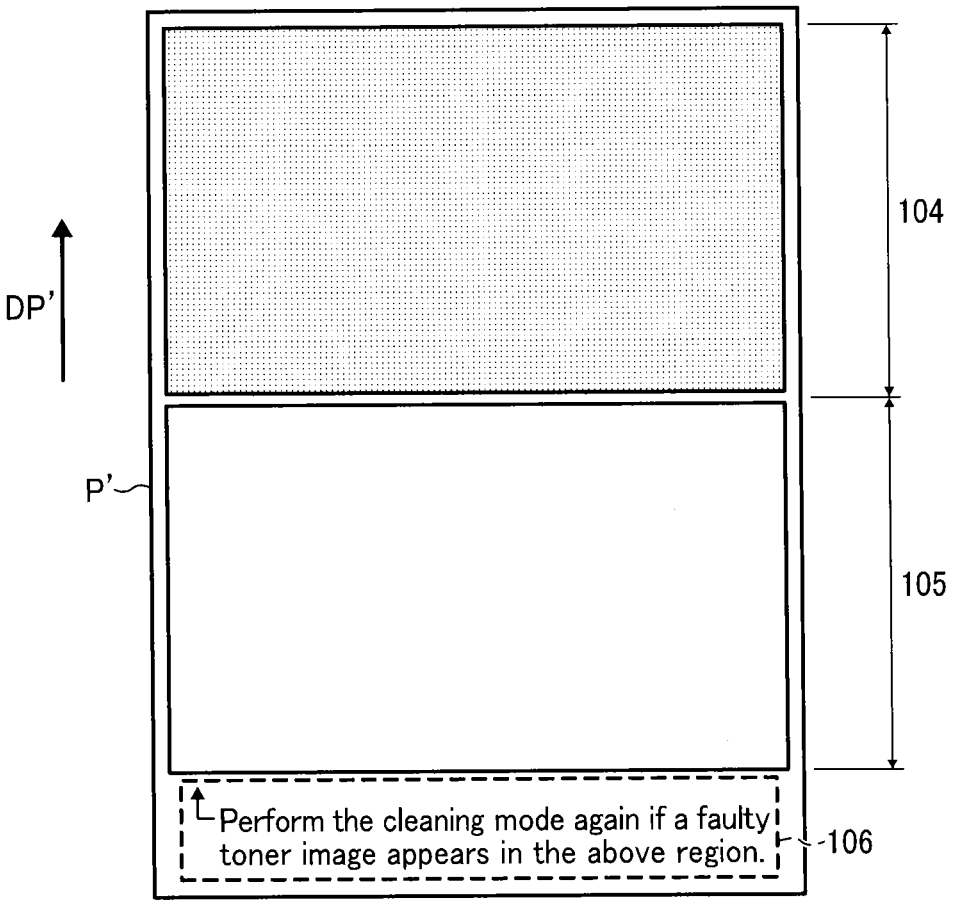
FIG. 8 is a plan view of the sheet shown in FIG. 4 illustrating an instruction region thereon.

If the check region 105 on the sheet P' bears the offset toner image 202 as shown in FIG. 7A, it is necessary to perform the cleaning mode again. To address this circumstance, the sheet P' includes an instruction region 106 having an instruction relating to the check region 105 as shown in FIG. 8. FIG. 8 is a plan view of the sheet P' illustrating the instruction region 106. As shown in FIG. 8, the instruction region 106 is disposed upstream from the check region 105 in the sheet conveyance direction DP'. The instruction region 106 states that "Perform the cleaning mode again if a faulty toner image appears in the above region." so that the user determines whether or not to perform the cleaning mode again. Alternatively, if the image forming apparatus 1 has the control panel 200 as shown in FIG. 1, the control panel 200 may display the instruction on the instruction region 106.

A description is provided of a duplex printing cleaning for cleaning the fixing device 20 with the sheet P' by using duplex printing of the image forming apparatus 1.

Figure 9A:
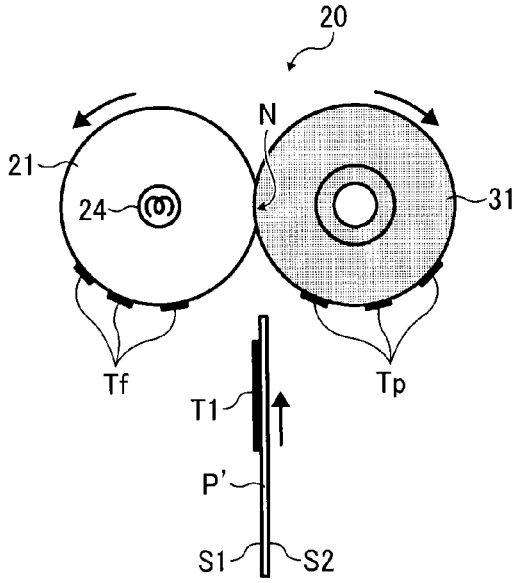
FIG. 9A is a schematic vertical sectional view of the fixing device shown in FIG. 2 illustrating the sheet before entering a fixing nip during a first conveyance of the sheet.
Figure 9B:
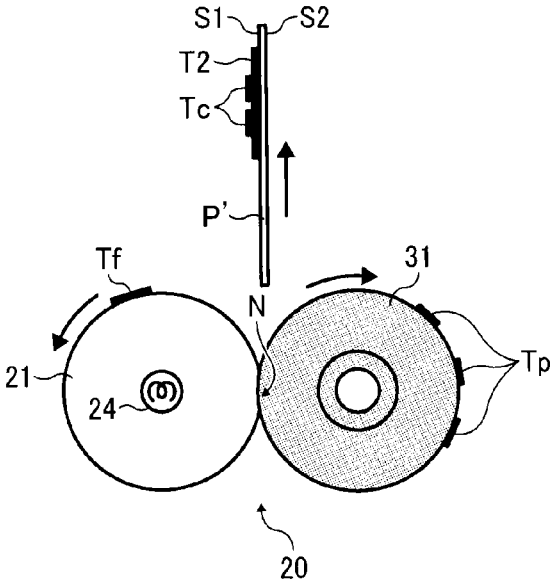
FIG. 9B is a schematic vertical sectional view of the fixing device shown in FIG. 2 illustrating the sheet after being ejected from the fixing nip during the first conveyance of the sheet.
Figure 9C:
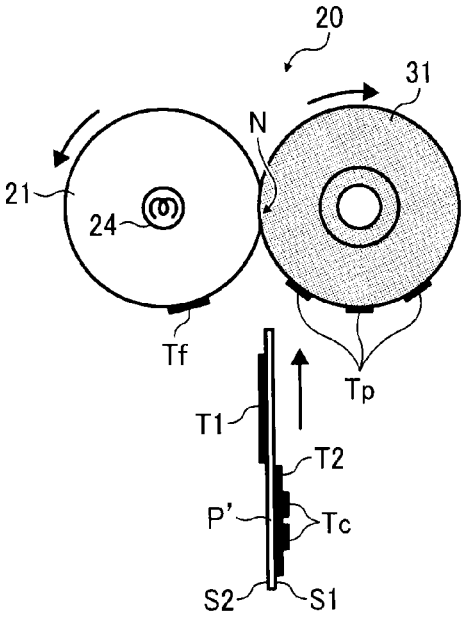
FIG. 9C is a schematic vertical sectional view of the fixing device shown in FIG. 2 illustrating the sheet before entering the fixing nip during a second conveyance of the sheet.
Figure 9D:
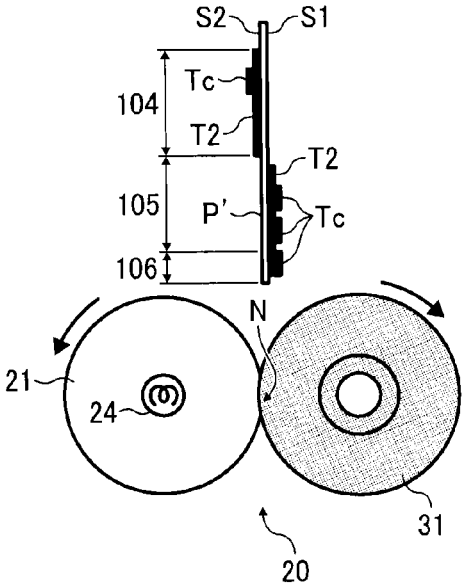
FIG. 9D is a schematic vertical sectional view of the fixing device shown in FIG. 2 illustrating the sheet after being ejected from the fixing nip during the second conveyance of the sheet.

FIGS. 9A, 9B, 9C, and 9D illustrate the fixing device 20 for explaining the duplex printing cleaning. FIG. 9A is a schematic vertical sectional view of the fixing device 20 illustrating the sheet P' before entering the fixing nip N during a first conveyance of the sheet P'. FIG. 9B is a schematic vertical sectional view of the fixing device 20 illustrating the sheet P' after being ejected from the fixing nip N during the first conveyance of the sheet P'. FIG. 9C is a schematic vertical sectional view of the fixing device 20 illustrating the sheet P' before entering the fixing nip N during a second conveyance of the sheet P'. FIG. 9D is a schematic vertical sectional view of the fixing device 20 illustrating the sheet P' after being ejected from the fixing nip N during the second conveyance of the sheet P'. As shown in FIG. 9D, the cleaning region 104, the check region 105, and the instruction region 106 are created on a second side S2 (e.g., the back side) of the sheet P'.

The duplex printing cleaning is performed by a fixing operation of the fixing roller 21 and the pressure roller 31 and an operation of the image forming apparatus 1 for duplex printing. For example, the user instructs the image forming apparatus 1 to perform the duplex printing cleaning through the control panel 200 or the client computer 300 connected to the image forming apparatus 1. Thus, the controller 400 identifies the print mode or the cleaning mode.

Optionally, the control panel 200 or a display connected to the client computer 300 may display an instruction that instructs the user to select the sheet P' having an increased width, that is, a maximum width, in the axial direction of the fixing roller 21 that is available in the image forming apparatus 1. Accordingly, a cleaning span on the fixing roller 21 in the axial direction thereof where the sheet P' is conveyed to remove the stain toner 203 from the fixing roller 21 is enlarged.

Alternatively, the control panel 200 or the display connected to the client computer 300 may display an instruction that instructs the user to set the sheet P' having a paper weight not greater than about 90 g/m$^2$. As the paper weight of the sheet P' increases, the thermal capacity of the sheet P' increases. Accordingly, toner of a fixed toner image T2 fixed on a first side S1 (e.g., the front side) of the sheet P' that faces the pressure roller 31 during the second conveyance of the sheet P' as shown in FIG. 9C may not melt readily, degrading cleaning of the pressure roller 31. To address this circumstance, the paper weight of the sheet P' is not greater than a predetermined value, for example, not greater than 90 g/m$^2$.

FIG. 9A illustrates the sheet P' bearing an unfixed toner image T1 before entering the fixing nip N for the first conveyance of the sheet P' when the first side S1 of the sheet P' faces the fixing roller 21. The outer circumferential surface of the fixing roller 21 is adhered with a stain toner Tf. The outer circumferential surface of the pressure roller 31 is adhered with a stain toner Tp.

FIG. 9B illustrates the sheet P' ejected from the fixing nip N after the sheet P' is conveyed through the fixing nip N during the first conveyance of the sheet P' in a state in which the first side S1 of the sheet P' faces the fixing roller 21 and the second side S2 of the sheet P' faces the pressure roller 31. While the sheet P' is conveyed through the fixing nip N, the unfixed toner image T1, that is, the cleaning toner image T104 depicted in FIG. 4, formed on the sheet P' depicted in FIG. 9A is melted and fixed on the sheet P' under heat and pressure from the fixing roller 21 and the pressure roller 31. Thus, a fixed toner image T2 is formed on the sheet P' as shown in FIG. 9B.

The stain toner Tf adhered to the fixing roller 21 is transferred onto the sheet P' via the toner image T2 melted under heat from the sheet P' to have viscosity as a stain toner Tc removed from the fixing roller 21 and mounted on the toner image T2 as shown in FIG. 9B. Thus, as the sheet P' is conveyed through the fixing nip N during the first conveyance therethrough, the sheet P' removes the stain toner Tf from the fixing roller 21.

FIG. 9C illustrates the sheet P' before entering the fixing nip N for the second conveyance of the sheet P' when the first side S1 of the sheet P' faces the pressure roller 31 and the second side S2 of the sheet P' faces the fixing roller 21. The second side S2 of the sheet P' that faces the fixing roller 21 bears another unfixed toner image T1, that is, the cleaning toner image T104 depicted in FIG. 4. While the sheet P' is conveyed through the fixing nip N, the unfixed toner image T1 formed on the second side S2 of the sheet P' is melted and fixed on the sheet P' under heat and pressure from the fixing roller 21 and the pressure roller 31. Thus, another fixed toner image T2 is formed on the sheet P' as shown in FIG. 9D.

A residual stain toner Tf adhered to the fixing roller 21 is transferred onto the sheet P' by another toner image T2 melted under heat from the sheet P' to have viscosity as another stain toner Tc removed from the fixing roller 21 and mounted on the toner image T2 as shown in FIG. 9D. Thus, the sheet P' removes the stain toner Tf from the fixing roller 21.

As shown in FIG. 9D, while the sheet P' is conveyed through the fixing nip N, the fixed toner image T2 formed on the first side S1 of the sheet P' that faces the pressure roller 31 is also melted by heat from the fixing roller 21 and the pressure roller 31. Thus, the stain toner Tp adhered to the pressure roller 31 is transferred onto the sheet P' via the fixed toner image T2 that attains viscosity under heat at the fixing nip N as another stain toner Tc removed from the pressure roller 31 and mounted on the toner image T2 as shown in FIG. 9D.

Thus, as the sheet P' is conveyed through the fixing nip N during the first conveyance, the stain toner Tf is transferred from the fixing roller 21 onto the sheet P'. As the sheet P' is conveyed through the fixing nip N during the second conveyance, the stain toners Tf and Tp are transferred from the fixing roller 21 and the pressure roller 31 onto the sheet P', respectively, thus cleaning the fixing roller 21 and the pressure roller 31. The user confirms that the duplex printing cleaning has finished by checking the check region 105 on the sheet P'.

Toner of the unfixed toner image T1 is melted by heat from the fixing roller 21 and the pressure roller 31 to attain viscosity that attracts the stain toner Tf. Similarly, toner of the fixed toner image T2 is melted again by heat from the fixing roller 21 and the pressure roller 31 to attain viscosity that attracts the stain toner Tp. Accordingly, by using at least one of the unfixed toner image T1 and the fixed toner image T2, the sheet P' removes the stain toner Tf from the fixing roller 21 or removes both the stain toners Tf and Tp from the fixing roller 21 and the pressure roller 31, respectively, while the sheet P' is conveyed through the fixing nip N like in a single print job for one-sided printing or duplex printing.

For example, in the duplex printing cleaning, as the unfixed toner image T1 formed on the first side S1 of the sheet P' that faces the fixing roller 21 during the first conveyance of the sheet P' melts, the sheet P' removes the stain toner Tf from the fixing roller 21. During the second conveyance of the sheet P', as the unfixed toner image T1 formed on the second side S2 of the sheet P' that faces the fixing roller 21 and the fixed toner image T2 formed on the first side S1 of the sheet P' that faces the pressure roller 31 melt, the sheet P' removes the stain toners Tf and Tp from the fixing roller 21 and the pressure roller 31, respectively. Thus, the sheet P' cleans the fixing roller 21 and the pressure roller 31 while it is conveyed through the fixing nip N like in a single print job.

Additionally, in the duplex printing cleaning, paper dust and a filler contained in the stain toner Tp being adhered to the outer circumferential surface of the pressure roller 31 and containing a substantial amount of paper dust are selectively transferred onto the outer circumferential surface of the fixing roller 21. Thereafter, the paper dust and the filler transferred to the outer circumferential surface of the fixing roller 21 are adhered to the melted solid toner image T1 formed on the sheet P', thus being removed from the fixing device 20.

A description is provided of cleaning processes for cleaning the fixing roller 21.

Figure 10:
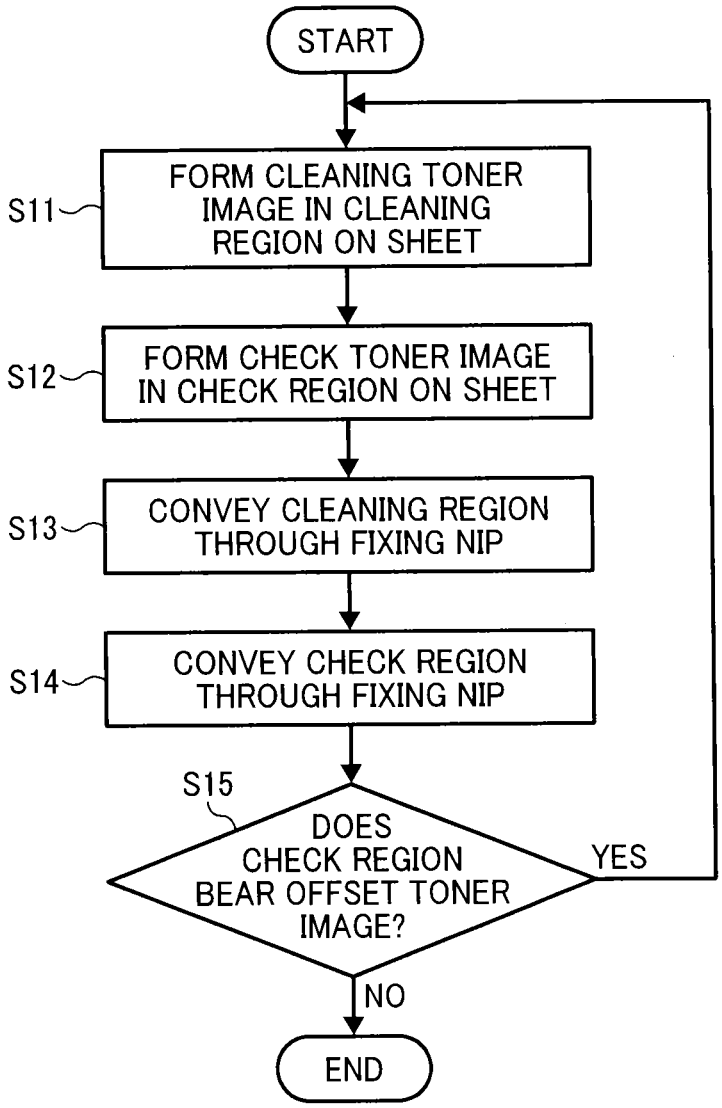
FIG. 10 is a flowchart showing a cleaning for cleaning the fixing device shown in FIG. 2 with the sheet.

FIG. 10 is a flowchart showing the cleaning processes of a cleaning for cleaning the fixing roller 21 shown in FIGS. 7A and 7B with the sheet P'.

In step S11, the controller 400 depicted in FIG. 6 controls at least one of the image forming devices 4Y, 4M, 4C, and 4K depicted in FIG. 1 to form a cleaning toner image T104 shown in FIG. 4 in the cleaning region 104 on the sheet P'. In step S12, the controller 400 controls at least one of the image forming devices 4Y, 4M, 4C, and 4K to form a check toner image T105 shown in FIG. 5A or 5B in the check region 105 on the sheet P'. In step S13, the controller 400 controls the fixing device 20 shown in FIG. 2 to convey the cleaning region 104 on the sheet P' through the fixing nip N to attract the stain toner 203 from the fixing roller 21. In step S14, the controller 400 controls the fixing device 20 to convey the check region 105 on the sheet P' through the fixing nip N. In step S15, the user checks whether or not the check region 105 on the sheet P' bears an offset toner image 202 shown in FIG. 7A. If the check region 105 on the sheet P' bears the offset toner image 202 (YES in step S15), the user instructs the controller 400 to perform the cleaning again in step S11.

A description is provided of cleaning processes for cleaning the fixing roller 21 by using duplex printing of the image forming apparatus 1.

Figure 11:
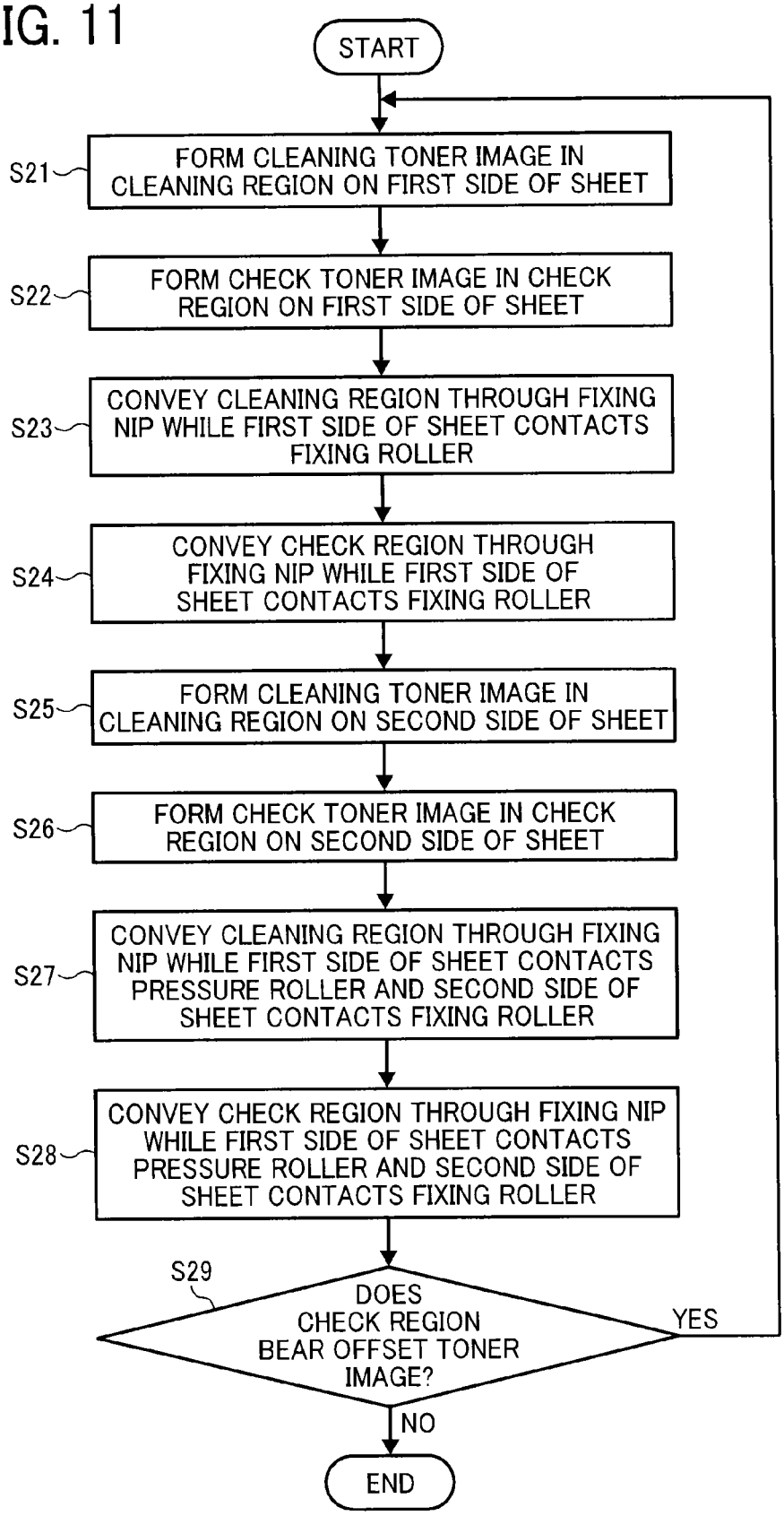
FIG. 11 is a flowchart showing a duplex printing cleaning for cleaning the fixing device shown in FIG. 2 with the sheet by using duplex printing of the image forming apparatus shown in FIG. 1.

FIG. 11 is a flowchart showing the duplex printing cleaning for cleaning the fixing roller 21 and the pressure roller 31 shown in FIG. 2 with the sheet P'.

In step S21, the controller 400 depicted in FIG. 6 controls at least one of the image forming devices 4Y, 4M, 4C, and 4K depicted in FIG. 1 to form a cleaning toner image T1 shown in FIG. 9A in the cleaning region 104 on the first side S1 of the sheet P'. In step S22, the controller 400 controls at least one of the image forming devices 4Y, 4M, 4C, and 4K to form a check toner image T105 shown in FIG. 5A or 5B in the check region 105 on the first side S1 of the sheet P'. In step S23, the controller 400 controls the fixing device 20 shown in FIG. 2 to convey the cleaning region 104 on the sheet P' through the fixing nip N while the first side S1 of the sheet P' contacts the fixing roller 21 to attract the stain toner Tf from the fixing roller 21. In step S24, the controller 400 controls the fixing device 20 to convey the check region 105 on the sheet P' through the fixing nip N while the first side S1 of the sheet P' contacts the fixing roller 21. In step S25, the controller 400 controls at least one of the image forming devices 4Y, 4M, 4C, and 4K to form another cleaning toner image T1 shown in FIG. 9C in the cleaning region 104 on the second side S2 of the sheet P'. In step S26, the controller 400 controls at least one of the image forming devices 4Y, 4M, 4C, and 4K to form another check toner image T105 shown in FIG. 5A or 5B in the check region 105 on the second side S2 of the sheet P'. In step S27, the controller 400 controls the fixing device 20 to convey the cleaning region 104 on the sheet P' through the fixing nip N while the first side S1 of the sheet P' contacts the pressure roller 31 and the second side S2 of the sheet P' contacts the fixing roller 21 so as to attract the stain toner Tf from the fixing roller 21 and the stain toner Tp from the pressure roller 31. In step S28, the controller 400 controls the fixing device 20 to convey the check region 105 on the sheet P' through the fixing nip N while the first side S1 of the sheet P' contacts the pressure roller 31 and the second side S2 of the sheet P' contacts the fixing roller 21. In step S29, the user checks whether or not the check region 105 on the sheet P' bears an offset toner image 202 shown in FIG. 7A. If the check region 105 on the sheet P' bears the offset toner image 202 (YES in step S29), the user instructs the controller 400 to perform the duplex printing cleaning again in step S21.

The present disclosure is not limited to the details of the exemplary embodiments described above and various modifications and improvements are possible. For example, according to the exemplary embodiments described above, a solid monochrome black toner image as the cleaning toner image T104 is formed in the cleaning region 104 on the sheet P'. Alternatively, instead of the solid toner image, a toner image having a print rate smaller than 100 percent (e.g., a halftone image and a toner image having a pattern made of lateral stripes) may be formed according to an amount of the stain toners Tf and Tp and the like inside the fixing device 20.

Yet alternatively, the cleaning toner image T104 may be formed in the cleaning region 104 on the sheet P' with toner in colors other than black or in mixed colors. If the cleaning toner image T104 is formed with toner in a plurality of colors, the sheet P' bears an increased amount of toner having an increased height, enhancing an adhesion of the cleaning toner image T104 to adhere the stain toners Tf and Tp to the sheet P'. For example, a cleaning layer may be formed with toner in four colors, that is, yellow, magenta, cyan, and black, at an identical print rate to even an amount of consumption of the toner in the four colors.

A pattern used for the cleaning layer may be made of a toner image spanning throughout a width of the fixing nip N in the axial direction of the fixing roller 21 perpendicular to the recording medium conveyance direction DP. The sheet P' used in the cleaning mode may be the recording medium P used for a print job or a sheet exclusively used for the cleaning mode. The heater 24 serving as a heater or a heat source may be disposed outside the fixing roller 21 and disposed opposite the outer circumferential surface of the fixing roller 21 to heat the fixing roller 21 from an outside of the fixing roller 21.

A description is provided of advantages of the image forming apparatus 1.

As shown in FIG. 1, the image forming apparatus 1 includes an image forming device (e.g., the image forming devices 4Y, 4M, 4C, and 4K) that forms a toner image (e.g., the toner image T) on a recording medium (e.g., the recording medium P) and a fixing device (e.g., the fixing device 20) that fixes the toner image on the recording medium. As shown in FIG. 2, the fixing device includes a first rotator (e.g., the fixing roller 21) and a second rotator (e.g., the pressure roller 31) pressed against the first rotator to form the fixing nip N therebetween. As the recording medium bearing the toner image is conveyed through the fixing nip N, the first rotator and the second rotator fix the toner image on the recording medium under heat and pressure. The image forming apparatus 1 has a cleaning mode that removes stain toner from an outer circumferential surface of at least one of the first rotator and the second rotator as a cleaning sheet (e.g., the sheet P') is conveyed through the fixing nip N.

As shown in FIG. 4, in the cleaning mode, the image forming device forms an image pattern on the cleaning sheet. The image pattern includes the cleaning toner image T104 formed in the cleaning region 104 disposed at a leading section of the cleaning sheet and the check toner image T105 formed in the check region 105 disposed at a trailing section of the cleaning sheet in the sheet conveyance direction DP'. Each of the cleaning region 104 and the check region 105 has a length (e.g., the lengths L104 and L105) in the sheet conveyance direction DP' that is greater than a circumferential length of the first rotator. The cleaning region 104 bears an unfixed toner image having an increased toner density as the cleaning toner image T104. The check region 105 bears a toner image having a decreased toner density as the check toner image T105. A cleaning temperature of the first rotator is lower than a fixing temperature at which the toner image is fixed on the recording medium and higher than a cold offset temperature at which cold offset occurs.

As shown in FIG. 4, in the cleaning mode, the unfixed cleaning toner image T104 formed in the cleaning region 104 on the cleaning sheet situated at the leading section of the cleaning sheet in the sheet conveyance direction DP' attains an adhesion by heat from the fixing nip N to attract the stain toner 203 from the first rotator without offset so that the stain toner 203 is fixed on the cleaning sheet as shown in FIG. 7B, thus removing the stain toner 203 from the first rotator while the cleaning sheet is conveyed through the fixing nip N like in a print job. If the stain toner 203 is not adhered to the cleaning region 104 on the cleaning sheet and therefore is remained on the outer circumferential surface of the first rotator, a part of the unfixed cleaning toner image T104 formed in the cleaning region 104 on the cleaning sheet is transferred onto the stain toner 203 remaining on the first rotator and further transferred onto the check region 105 on the cleaning sheet, allowing the user to check that the cleaning region 104 on the cleaning sheet has not removed the stain toner 203 from the first rotator completely.

Accordingly, in the cleaning mode, the cleaning sheet removes the stain toner 203 from the first rotator while the cleaning sheet is conveyed through the fixing nip N like in the single print job. Additionally, the cleaning sheet allows the user to readily check whether or not the cleaning sheet has removed the stain toner 203 from the first rotator.

According to the exemplary embodiments described above, the fixing roller 21 serves as a first rotator. Alternatively, a fixing belt, a fixing film, a fixing sleeve, or the like may be used as a first rotator. Further, the pressure roller 31 serves as a second rotator. Alternatively, a pressure belt or the like may be used as a second rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. An image forming apparatus comprising:

an image forming device to form a cleaning toner image having a first toner density in a cleaning region on a cleaning sheet and a check toner image having a second toner density in a check region on the cleaning sheet, wherein the first toner density is greater than the second toner density, and wherein at least one of (1) the second toner density is greater than zero and (2) the check region on the cleaning sheet has a print rate greater than zero percent; and a fixing device disposed downstream from the image forming device in a cleaning sheet conveyance direction, the fixing device including:

a first rotator;

a second rotator pressed against the first rotator to form a fixing nip therebetween, through which the cleaning sheet is conveyed, at least one of the first rotator and the second rotator being adhered with stain toner; and a heater to heat the first rotator to a cleaning temperature that is lower than a fixing temperature to which the first rotator is heated in a print job and higher than a cold offset temperature at which toner adheres to the first rotator by cold offset, each of the cleaning region and the check region having a length greater than a circumferential length of the first rotator, the cleaning region being disposed at a leading section of the cleaning sheet in the cleaning sheet conveyance direction, the check region being disposed at a trailing section of the cleaning sheet in the cleaning sheet conveyance direction.

2. The image forming apparatus according to claim 1, wherein the cleaning toner image in the cleaning region on the cleaning sheet includes a solid toner image.

3. The image forming apparatus according to claim 1, wherein the check region on the cleaning sheet has a print rate not greater than about 50 percent.

4. The image forming apparatus according to claim 1, wherein the check toner image in the check region on the cleaning sheet includes one of a white background image, a halftone image, and a ruled image.

5. The image forming apparatus according to claim 1, wherein the cleaning region and the check region are provided on at least one of a front side and a back side of the cleaning sheet.

6. The image forming apparatus according to claim 5, wherein the front side of the cleaning sheet comes into contact with the first rotator.

7. The image forming apparatus according to claim 1, wherein the cleaning sheet further includes an instruction region, disposed upstream from the check region in the cleaning sheet conveyance direction, which has an instruction relating to the check region.

8. The image forming apparatus according to claim 7, wherein the instruction region is disposed on at least one of a front side and a back side of the cleaning sheet.

9. The image forming apparatus according to claim 1, wherein the image forming apparatus has a cleaning mode in which the image forming device forms the cleaning toner image and the check toner image on the cleaning sheet and the fixing device conveys the cleaning sheet through the fixing nip.

10. The image forming apparatus according to claim 9, further comprising a control panel operatively connected to the image forming device and the fixing device to select the cleaning mode.

11. The image forming apparatus according to claim 10, wherein at least one of the cleaning temperature of the first rotator, pressure with which the second rotator is pressed against the first rotator, and a conveyance speed at which the first rotator and the second rotator convey the cleaning sheet through the fixing nip is specified through the control panel.

12. The image forming apparatus according to claim 10, wherein the control panel displays an instruction to select the cleaning sheet of an increased width in an axial direction of the first rotator that is available in the image forming apparatus when the cleaning mode starts.

13. The image forming apparatus according to claim 10, wherein the control panel displays an instruction to set the cleaning sheet having a paper weight not greater than about 90 $g/m^2$ when the cleaning mode starts.

14. The image forming apparatus according to claim 9, wherein the image forming apparatus receives an instruction to perform the cleaning mode from a client computer connected to the image forming apparatus.

15. The image forming apparatus according to claim 1, wherein the check region is contiguous to the cleaning region in the cleaning sheet conveyance direction.

16. The image forming apparatus according to claim 1, wherein the cleaning temperature is in a range of from about 150 degrees centigrade to about 170 degrees centigrade.

17. The image forming apparatus according to claim 1, wherein the first rotator includes a fixing roller and the second rotator includes a pressure roller.

18. An image forming method comprising:

forming a cleaning toner image having a first toner density in a cleaning region on a first side of a cleaning sheet;

forming a check toner image having a second toner density in a check region on the first side of the cleaning sheet, wherein the first toner density is greater than the second toner density, and wherein at least one of (1) the second toner density is greater than zero and (2) the check region on the cleaning sheet has a print rate greater than zero percent;

conveying the cleaning region through a fixing nip formed between a first rotator adhered with stain toner and a second rotator while the first side of the cleaning sheet contacts the first rotator; and conveying the check region through the fixing nip while the first side of the cleaning sheet contacts the first rotator.

19. The image forming method according to claim 18, further comprising:

forming another cleaning toner image in the cleaning region on a second side of the cleaning sheet;

forming another check toner image in the check region on the second side of the cleaning sheet;

conveying the cleaning region through the fixing nip while the first side of the cleaning sheet contacts the second rotator adhered with stain toner and the second side of the cleaning sheet contacts the first rotator adhered with stain toner; and conveying the check region through the fixing nip while the first side of the cleaning sheet contacts the second rotator and the second side of the cleaning sheet contacts the first rotator.

* * * * *